US011815247B2

(12) United States Patent
Smets et al.

(10) Patent No.: US 11,815,247 B2
(45) Date of Patent: Nov. 14, 2023

(54) LUMINAIRE SYSTEM WITH IMPROVED FASTENING MEANS

(71) Applicant: Schreder S.A., Brussels (BE)

(72) Inventors: Paul Smets, Liege (BE); Guy Pluimers, Awans (BE)

(73) Assignee: Schreder S.A., Brussels (BE)

( * ) Notice: Subject to any disclaimer, the term of this patent is extended or adjusted under 35 U.S.C. 154(b) by 0 days.

(21) Appl. No.: 17/414,081

(22) PCT Filed: Dec. 24, 2019

(86) PCT No.: PCT/EP2019/087025
§ 371 (c)(1),
(2) Date: Jun. 15, 2021

(87) PCT Pub. No.: WO2020/163205
PCT Pub. Date: Jul. 2, 2020

(65) Prior Publication Data

US 2022/0042674 A1 Feb. 10, 2022

(30) Foreign Application Priority Data

Dec. 24, 2018 (NL) ..... 2022300

(51) Int. Cl.
*F21V 17/12* (2006.01)
*F21V 29/70* (2015.01)
(Continued)

(52) U.S. Cl.
CPC ..... *F21V 17/12* (2013.01); *F21V 23/004* (2013.01); *F21V 29/70* (2015.01); *F21V 19/0055* (2013.01); *F21Y 2115/10* (2016.08)

(58) Field of Classification Search
CPC ..... F21V 17/12; F21V 23/004; F21V 29/70; F21V 19/0055; F21V 5/007; F21V 19/0035; F21Y 2115/10; F21Y 2105/10
See application file for complete search history.

(56) References Cited

U.S. PATENT DOCUMENTS

2005/0190553 A1* 9/2005 Lynch ..... F21V 3/04 362/227
2009/0135608 A1* 5/2009 Sell ..... F21V 19/0055 362/365

(Continued)

FOREIGN PATENT DOCUMENTS

DE 202018101795 U1 4/2018
EP 2924333 A1 * 9/2015 ..... F21S 2/005

(Continued)

OTHER PUBLICATIONS

English Translation of EP2924333A1; Rusterholz; (Year: 2014).*
PCT International Search Report and Written Opinion, Application No. PCT/EP2019/087025, dated Feb. 6, 2020, 10 pages.

*Primary Examiner* — Jong-Suk James Lee
*Assistant Examiner* — Glenn Zimmerman
(74) *Attorney, Agent, or Firm* — McDonnell Boehnen Hulbert & Berghoff LLP

(57) ABSTRACT

Example embodiments relate to luminaire systems with improved fastening means. One example luminaire system includes a first support provided with a recess. The luminaire system also includes a plurality of light sources arranged on said first support. In addition, the luminaire system includes a second support arranged opposite said first support. Further, the luminaire system includes one or more optical elements provided to said second support, and associated with the plurality of light sources. Additionally, the luminaire system includes a fastening element that includes a head portion and a rod portion. The second support is provided with a through-hole for receiving said head portion. Said rod portion extends through said through-hole and said recess in order to be fixed in the first support and/or in a portion of the luminaire system. The second support is provided with a protruding portion.

19 Claims, 12 Drawing Sheets

(51) Int. Cl.

| | |
|---|---|
| ***F21V 23/00*** | (2015.01) |
| *F21Y 115/10* | (2016.01) |
| *F21V 19/00* | (2006.01) |

(56) References Cited

U.S. PATENT DOCUMENTS

2010/0061092 A1* 3/2010 Yang ..... F21V 29/75
362/234
2010/0226136 A1* 9/2010 Murakoshi ..... F21V 19/0055
257/E33.057
2011/0304269 A1* 12/2011 Wang ..... F21K 9/00
315/113
2015/0117033 A1* 4/2015 Chiu ..... F21V 19/0055
362/363
2018/0066815 A1* 3/2018 Chen ..... F21V 31/005

FOREIGN PATENT DOCUMENTS

WO 2013153008 A1 10/2013
WO WO-2013153008 A1 * 10/2013 ..... F16B 5/0241

* cited by examiner

LUMINAIRE SYSTEM WITH IMPROVED FASTENING MEANS

CROSS-REFERENCE TO RELATED APPLICATIONS

The present application is a national stage entry of PCT/EP2019/087025 filed Dec. 24, 2019, which claims priority to NL 2022300 filed Dec. 24, 2018, the contents of each of which are hereby incorporated by reference.

FIELD OF INVENTION

The present invention relates to luminaire systems. Particular embodiments relate to a luminaire system with a second support, e.g. an optical element plate, which is coupled to a first support, e.g. a PCB, using fastening means.

BACKGROUND

Currently, in the luminaire production, different components inside a luminaire system are fastened to one another, such as a printed circuit board (PCB) serving as a support for light sources together with an optical element plate for a specific luminaire application. A common solution to fasten such components is to use screws and the like as fastening elements. Using ordinary screws may damage the optical element plate during the fastening operation, as the resulting pressure may be too important for such fragile component. Using specific screws/fixation elements may solve the above-mentioned problem, but may result in a more complicated dimensioning of the different components to be fastened and/or of the fastening elements. Such approach is costly, time consuming, and requires extensive stock keeping. It would therefore be advantageous to provide a luminaire system wherein a fastening operation of different components is improved, and is made more adjustable.

SUMMARY

The object of embodiments of the invention is to provide a luminaire system whose components can be fastened to one another in a flexible and reliable way with a reduced risk that the components are damaged.

According to a first aspect of the invention, there is provided a luminaire system comprising a first support provided with a recess, a plurality of light sources arranged on said first support, a second support arranged opposite said first support, one or more optical elements provided to said second support and associated with the plurality of light sources, and a fastening element comprising a head portion and a rod portion. The second support is provided with a through-hole for receiving said head portion. Said rod portion extends through said through-hole and said recess in order to be fixed in the first support and/or in a portion of the luminaire system. The second support is provided with a protruding portion protruding from an edge delimiting the through-hole underneath the head portion and in the recess. An overlap between the head portion and the first support is present when looking in a first direction perpendicular to the first support.

A common solution to fasten different components comprised in a luminaire system to one another and/or to the luminaire system is to use screws and the like as fastening elements. Using ordinary screws to fasten e.g. a first support comprising light sources to e.g. a second support comprising optical elements may damage during the fastening operation fragile components of the second support, such as optical plates carrying lenses, reflectors, collimators, etc. Indeed, the head portion of ordinary screws may be in contact with said second support, and the pressure resulting from the fastening operation may be too important for the above-mentioned fragile components. Moreover, by using specific screws, such as step screws and the like, as fastening elements may solve the above-mentioned problem related to a risk of damaging fragile elements in a luminaire system, but may result in a more complicated dimensioning of the different components to be fastened, and/or of the fastening elements. Using different fastening elements depending on the size of components to be fastened makes the production and installation task unnecessarily complicated. Moreover, it adds the disadvantage of having to store fastening elements of different sizes and/or types for production and/or for maintenance. This problem is overcome by a luminaire system as defined above.

By using a luminaire system wherein the second support is provided with a through-hole and a protruding portion as defined above, and wherein an overlap is present as defined above, a rod portion of the fastening element may be fixed in the first support and/or in a portion of the luminaire system whilst a head portion of said fastening element is enabled to be in contact with the first support. This arrangement avoids or limits the risk of damaging fragile elements in such a luminaire system. This arrangement also enables the use of any type of fastening element, and in particular the use of ordinary screws instead of specific screws, thereby facilitating the manufacture and dimensioning of the fastening element.

Preferably, the luminaire system is included in a luminaire head, and the first support is fixed in said luminaire head.

Preferred embodiments relate to a luminaire system of an outdoor luminaire By outdoor luminaire, it is meant luminaires which are installed on roads, tunnels, industrial plants, campuses, parks, cycle paths, pedestrian paths or in pedestrian zones, for example, and which can be used notably for the lighting of roads and residential areas in the public domain, as well as the lighting of private parking areas and access roads to private building infrastructures.

According to a preferred embodiment, the head portion is in contact with the first support over a contact area. According to an exemplary embodiment, said contact area is comprised between 25% and 75% of a surface area of the head portion, preferably between 33% and 66% of said surface area.

The contact between the head portion and the first support enables to apply the pressure resulting from the fastening operation on the first support instead of on the second support, the first support being more robust than the protruding portion of the second support.

According to a preferred embodiment, a gap is present between the head portion and the protruding portion in said first direction when the second support is supported by the first support, and the head portion and the protruding portion are in contact when the first support is supported by the second support. According to an exemplary embodiment, said gap is comprised between 0.01 mm and 0.5 mm, preferably between 0.05 mm and 0.2 mm.

In this way, the gap between the head portion and the protruding portion prevents from the risk of damaging the protruding portion of the second support, which may be a fragile element, during the fastening operation. The second support may be supported by the first support during e.g. the mounting operation of the second support on the first support, or during the fastening operation, or during any maintenance operation of the luminaire system. The first support may be supported by the second support e.g. when the luminaire system is operational in an installed position, during any maintenance operation of the luminaire system, or during any other operation than the above-cited operations. The dimensioning of said gap may be such that the light distribution of the luminaire system will not be affected to any notable extent by the change of distance between the head portion and the protruding portion, from a configuration wherein the second support is supported by the first support to a configuration wherein the first support is supported by the second support. The above-mentioned range of dimensions for said gap enables to achieve this result. The contact between the head portion and the protruding portion may be such that only a limited pressure is exerted on the protruding portion during the fastening operation. By light distribution, it is meant the light envelope in space, formed by the light emitted by the plurality of light sources through the one or more optical elements, and which represents the emission directions and the intensity variations of the light through the one or more optical elements.

According to another preferred embodiment, the head portion and the protruding portion are in contact when the second support is supported by the first support, and when the first support is supported by the second support. According to an exemplary embodiment, the protruding portion comprises a flexible element.

In this way, no change of distance between the head portion and the protruding portion occurs from a configuration wherein the second support is supported by the first support to a configuration wherein the first support is supported by the second support. The contact between the head portion and the protruding portion may be such that only a limited pressure is exerted on the protruding portion during the fastening operation. Using a flexible element for the protruding portion enables to achieve this result. Such flexible element may act as a spring element during the fastening operation.

Hence, the two above-mentioned embodiments correspond to two alternative embodiments preventing from the risk of damaging the protruding portion of the second support, which may be a fragile element, during the fastening operation. In the first embodiment, said gap is present when the second support is supported by the first support, whereas in the second embodiment no such gap is present, as the head portion and the protruding portion are in contact when the second support is supported by the first support and the protruding portion comprises the flexible element.

According to a preferred embodiment, the rod portion extends through the second support and through the first support.

In this way, the rod portion may be fixed in a portion of the luminaire system instead of in the first support, as said portion of the luminaire system may be more robust than the first support. Also, this way of fixing the first support and the second support in a portion of the luminaire system allows reducing the number of screws.

Particular embodiments of the invention aim to provide a luminaire system wherein a fastening element enables a movement of a support with respect to another support inside the luminaire system, thereby enabling the photometry of the luminaire to be adjusted on site and/or at the factory, depending on the application and the desired light distribution.

According to a preferred embodiment addressing this aim, dimensions of the recess and protruding portion are configured such that the second support is movable with respect to the first support along a second direction parallel to the first support.

In this way, the first support comprising said plurality of light sources may be fixed in the luminaire system, and the second support comprising said one or more optical elements may be movable relative to the first support. The light emitted by the plurality of light sources is correlated to different relative positions of the one or more optical elements with respect to the positions of the plurality of light sources, and can be adapted more easily to different sites and/or applications without having to mount different optical components. Having the plurality of light sources and the one or more optical elements on different supports allows making independent the positioning of one with respect to the other.

According to an exemplary embodiment, a difference between said length of the through-hole and said length of the head portion is at least equal to a difference between said length of the recess and said length of the protruding portion.

According to a preferred embodiment, the second support is arranged to be in contact with the first support, optionally movably in contact with the first support.

In this way, the distance between the first support and the second support is zero and fixed, which allows for a better determination of the expected light distribution corresponding to different positions of the second support with respect to the first support. In another embodiment, the second support is arranged to move at a fixed/predetermined distance from the first support, said distance being such that the protruding portion is underneath the head portion.

According to another possible embodiment, distance elements may be provided between the first support and the second support. Optionally, a surface of the second support facing the first support, or a surface of the first support facing the second support, may be provided with tracks or guides cooperating with the distance elements. Such tracks or guides may be formed integrally with the rest of the second support, or with the rest of the first support, respectively.

According to exemplary embodiments, a length of the recess along a third direction parallel to the first support and perpendicular to the second direction is at most equal to a length of the through-hole along said third direction.

In this manner, according to an embodiment wherein said length of the recess is smaller than said length of the through-hole, the contact area between the head portion and the first support may be increased, thereby improving the repartition of the pressure on the first support resulting from the fastening operation.

According to an exemplary embodiment, the protruding portion comprises a first protruding portion extending in the first direction into the recess, and a second protruding portion connected to an end of said first protruding portion and extending in the third direction underneath the head portion.

In this way, the protruding portion is L-shaped, and only the second protruding portion extends underneath the head portion, with a gap between the former and the latter.

According to a preferred embodiment, the luminaire system further comprises a carrier configured to carry the first support. Preferably, the rod portion extends in the carrier. Preferably, the carrier is a heat sink.

This arrangement allows heat dissipation of the first support via thermal contact with the luminaire system. Said portion of the luminaire system wherein the rod portion is fixed may be the carrier.

According to a preferred embodiment, the first support is a printed circuit board (PCB).

According to a preferred embodiment, the second support and the first support are arranged such that an optical element of the one or more optical elements extends over a corresponding light source of the plurality of light sources.

According to an exemplary embodiment, the one or more optical elements comprise a plurality of lens elements associated with the plurality of light sources.

Indeed, lens elements may be typically encountered in outdoor luminaire systems, although other types of optical elements may be additionally or alternatively present in such luminaires, such as reflectors, backlights, collimators, diffusors, and the like.

In the context of the invention, a lens element may include any transmissive optical element that focuses or disperses light by means of refraction. It may also include any one of the following: a reflective portion, a backlight portion, a prismatic portion, a collimator portion, a diffusor portion. For example, a lens element may have a lens portion with a concave or convex surface facing a light source, or more generally a lens portion with a flat or curved surface facing the light source, and optionally a collimator portion integrally formed with said lens portion, said collimator portion being configured for collimating light transmitted through said lens portion. Also, a lens element may be provided with a reflective portion or surface or with a diffusive portion.

Alternatively, the one or more optical elements could be a transparent or translucent cover, having optionally varying optical properties (e.g. variation of thickness, transparency, diffusivity, reflectivity, refractivity, color, color temperature etc.) along the movement direction of the second support.

Additionally, the one or more optical elements may further comprise one or more light shielding structures complying with different glare classifications, e.g. the G classification defined according to the CIE115:2010 standard and the G* classification defined according to the EN13201-2 standard. The light shielding structures may be configured for reducing a solid angle of light beams of the plurality of light sources by cutting off or reflecting light rays having a large incident angle, thereby reducing the light intensities at large angles and improving the G/G* classification of the luminaire system. The one or more optical elements may comprise on the one hand a lens plate comprising a plurality of lenses covering the plurality of light sources, and on the other hand one or more light shielding structures mounted on said lens plate. In such an embodiment, the lens plate and the one or more shielding structures form a second support which is movable relative to the first support.

According to one embodiment, the light shielding structures may comprise a plurality of closed reflective barrier walls, each having an interior bottom edge disposed on said flat portion, an interior top edge at a height above said flat portion, and a reflective surface connecting the interior bottom edge and the interior top edge and surrounding one or more associated lenses of said plurality of lenses. The height may be at least 2 mm, preferably at least 3 mm. The interior bottom edge defines a first closed line and the interior top edge defines a second closed line. Preferably, the first closed line and the second closed line comprising at least one curved portion over at least 15%, preferably over at least 20%, more preferably over at least 25%, of a perimeter of said first closed line and a perimeter of said second closed line, respectively. The reflective surface is configured for reducing a solid angle Ω of light beams emitted through the one or more associated lenses of said plurality of lenses. Exemplary embodiments of shielding structures are disclosed in patent application NL2023295 in the name of the applicant which is included herein by reference.

According to another embodiment, the light shielding structures may comprise a plurality of reflective barriers, each comprising a base surface disposed on said flat portion, a top edge at a height above said base surface, and a first reflective sloping surface connecting the base surface and the top edge and facing one or more associated lenses of said plurality of lenses. The first reflective sloping surface may be configured for reflecting light rays emitted through one or more associated first lenses of said plurality of lenses having a first incident angle with respect to an axis substantially perpendicular to the base surface between a first predetermined angle and 90°, with a first reflection angle with respect to said axis smaller than 60°. The first predetermined value may be a value below 90°. In other words, when the first incident angle is between the first predetermined value and 90°, the first reflective sloping surface reflects the incident ray such that the reflected ray has a reflection angle with respect to said axis smaller than 60°. According to an embodiment, at least one reflective barrier of the plurality of reflective barriers further comprises a second reflective sloping surface opposite the first reflective sloping surface, configured for reflecting light rays emitted through one or more associated second lenses of said plurality of lenses adjacent to the one or more first lenses associated with the first reflective sloping surface, having a second incident angle with respect to an axis substantially perpendicular to the base surface comprised between a second predetermined angle and 90°, with a second reflection angle with respect to said axis smaller than 60°. Exemplary embodiments of shielding structures are disclosed in patent application PCT/EP2019/074894 in the name of the applicant which is included herein by reference.

According to a preferred embodiment, the second support comprises an optical plate integrating the one or more optical elements. Optionally, the optical plate may be carried by a frame. Also, the frame may carry multiple optical plates together integrating the plurality of optical elements. According to another exemplary embodiment, the frame may comprise a surrounding fixture and a plurality of crossing elements extending between edges of the surrounding fixture. When multiple optical plates are carried by the frame, the crossing elements may extend along adjacent edges of two adjacent lens plates. In another embodiment, the second support may be the optical plate without a frame. For example, when the optical plate is sufficiently rigid, it may be used without a frame. In yet another embodiment, the plurality of optical elements may be separately formed and the second support may comprise a frame carrying the plurality of optical elements.

In this manner, the optical elements can be more easily replaced in case of maintenance or moved when the second support is moved with respect to the first support.

According to an embodiment wherein the one or more optical elements comprise a plurality of lens elements, optionally in combination with any one of the embodiments described above, a lens element of the plurality of lens elements has a first surface and a second surface located on opposite sides thereof. The first surface is a convex or planar surface and the second surface is a concave or planar surface facing a light source of the plurality of light sources.

In this manner, the light source placed at the second surface side of the lens element has its emitted light being spread. The shape of the lens element and position of the lens element with respect to the light source will influence the distribution and intensity profile of the emitted light.

According to an embodiment wherein the one or more optical elements comprise a plurality of lens elements, optionally in combination with any one of the embodiments described above, a light source of the plurality of light sources may be arranged under a so-called double bulged lens. This is a lens element having an internal surface facing the associated light source. The internal surface and/or an external surface comprises a first curved surface and a second curved surface, said first curved surface being connected to said second curved surface through a connecting surface or line comprising a saddle point or discontinuity. When the external surface is implemented as described, preferably the external surface comprises a first outwardly bulging surface, a second outwardly bulging surface, and an external connecting surface or line connecting said first and second outwardly bulging surfaces. However, it is also possible to have a continuous outer surface and to implement only the internal surface as described. When the internal surface is implemented as described, preferably the internal surface comprises a first outwardly bulging surface, a second outwardly bulging surface, and an internal connecting surface or line connecting said first and second outwardly bulging surfaces. The term "outwardly bulging surface" is used here to refer to a surface which bulges outwardly, away from the associated light source. An outwardly bulging external surface forms a protruding portion, whilst an outwardly bulging internal surface forms a cavity facing the associated light source.

By providing such curved surfaces, the optical elements are given a "double bulged" shape allowing to generate a distinct light distribution between a first beam emitted from the associated light source when located below the first bulge of the double bulged surface and a second beam emitted from the associated light source when located below the second bulge of the double bulged surface. Examples of such double bulged surfaces are disclosed in PCT publication WO2019134875A1 in the name of the applicant which is included herein by reference.

According to a preferred embodiment, the light sources are arranged in a two-dimensional array of at least two rows and at least two columns.

In this way, the mounting and connecting of the plurality of light sources on the first support is simplified. Similarly, the one or more optical elements may be arranged on the second support in a two-dimensional array of at least two rows and at least two columns. Further, different light sources may be arranged on the first support. For example, said light sources may have different colours or different colour temperatures. Further, different optical elements may be arranged on the second support. For example, said optical elements may have different shapes, or may comprise a transparent or translucent cover having different optical properties (e.g. differences of thickness, transparency, diffusivity, reflectivity, refractivity, colour, colour temperature, etc.).

BRIEF DESCRIPTION OF THE FIGURES

This and other aspects of the present invention will now be described in more detail, with reference to the appended drawings showing a currently preferred embodiment of the invention. Like numbers refer to like features throughout the drawings.

DESCRIPTION OF THE FIGURES

The luminaire system 1 of FIGS. 1A-5C may be included in a luminaire head. The luminaire head may be connected in any manner known to the skilled person to a luminaire pole. Typical examples of such systems are street lights. In other embodiments, the luminaire head may be connected to a wall or a surface, e.g. for illuminating buildings or tunnels.

FIGS. 1A-1F respectively illustrate a cross-sectional side view, a top view, another cross-sectional side view, two other top views, and a perspective view of a first exemplary embodiment of a luminaire system.

Figures 1A, 1B:
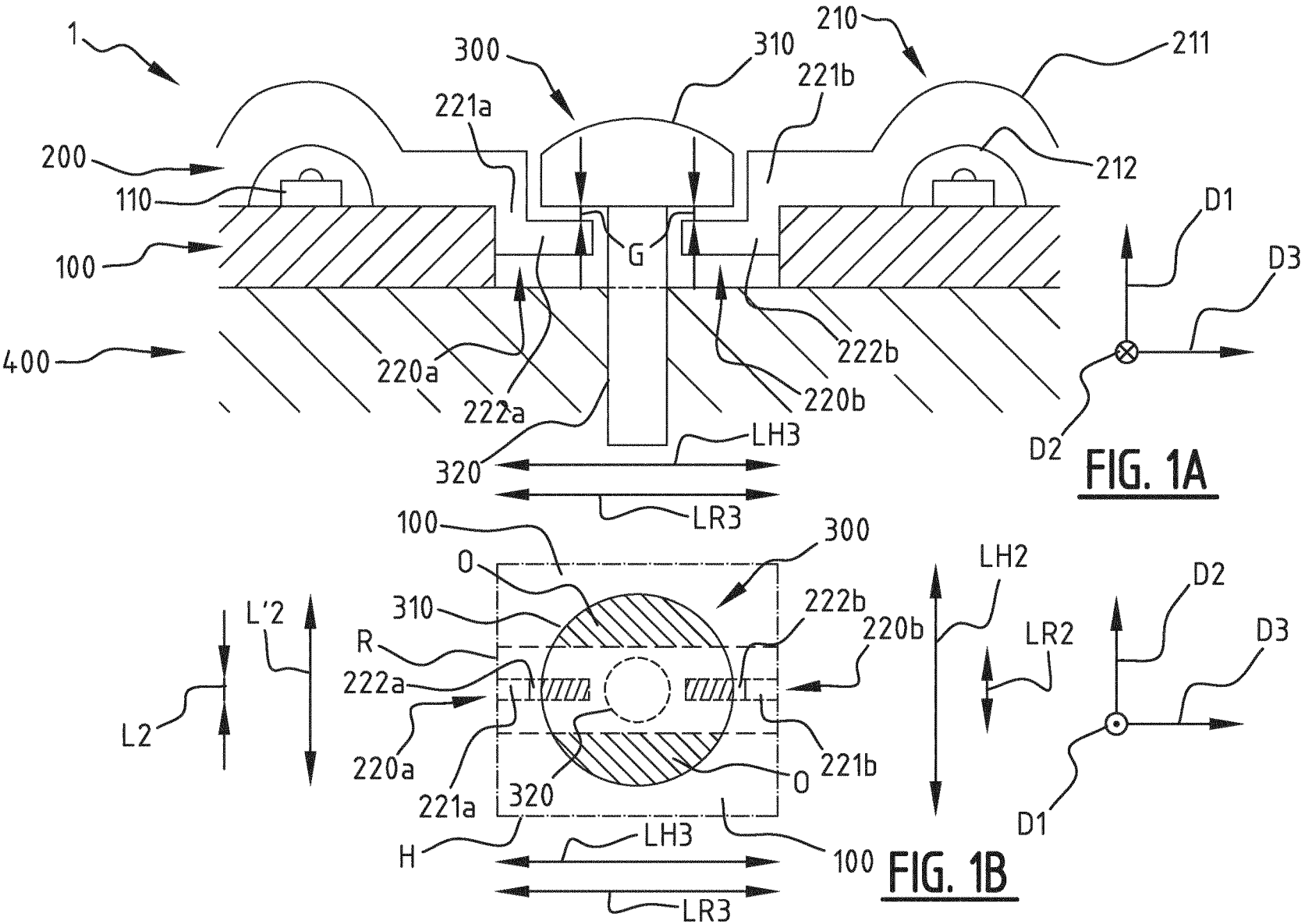
FIGS. 1A-1F respectively illustrate a cross-sectional side view, a top view, another cross-sectional side view, two other top views, and a perspective view of a first exemplary embodiment of a luminaire system.

As illustrated in FIGS. 1A-1E, the luminaire system 1 comprises a first support 100, a second support 200 arranged opposite said first support 100, and a fastening element 300 comprising a head portion 310 and a rod portion 320. As illustrated in FIG. 1A, a plurality of light sources 110 is arranged on the first support 100. One or more optical elements 210 are provided to the second support 200, and are associated with the plurality of light sources 110. The plurality of light sources 110 may be configured to emit light through the one or more optical elements 210. The plurality of light sources 110 may comprise a plurality of LEDs. Further, each light source 110 may comprise a plurality of LEDs, more particularly a multi-chip of LEDs. The plurality of light sources 110 could also be light sources other than LEDs, e.g. halogen, incandescent, or fluorescent lamp.

Figures 1C, 1D, 1E:
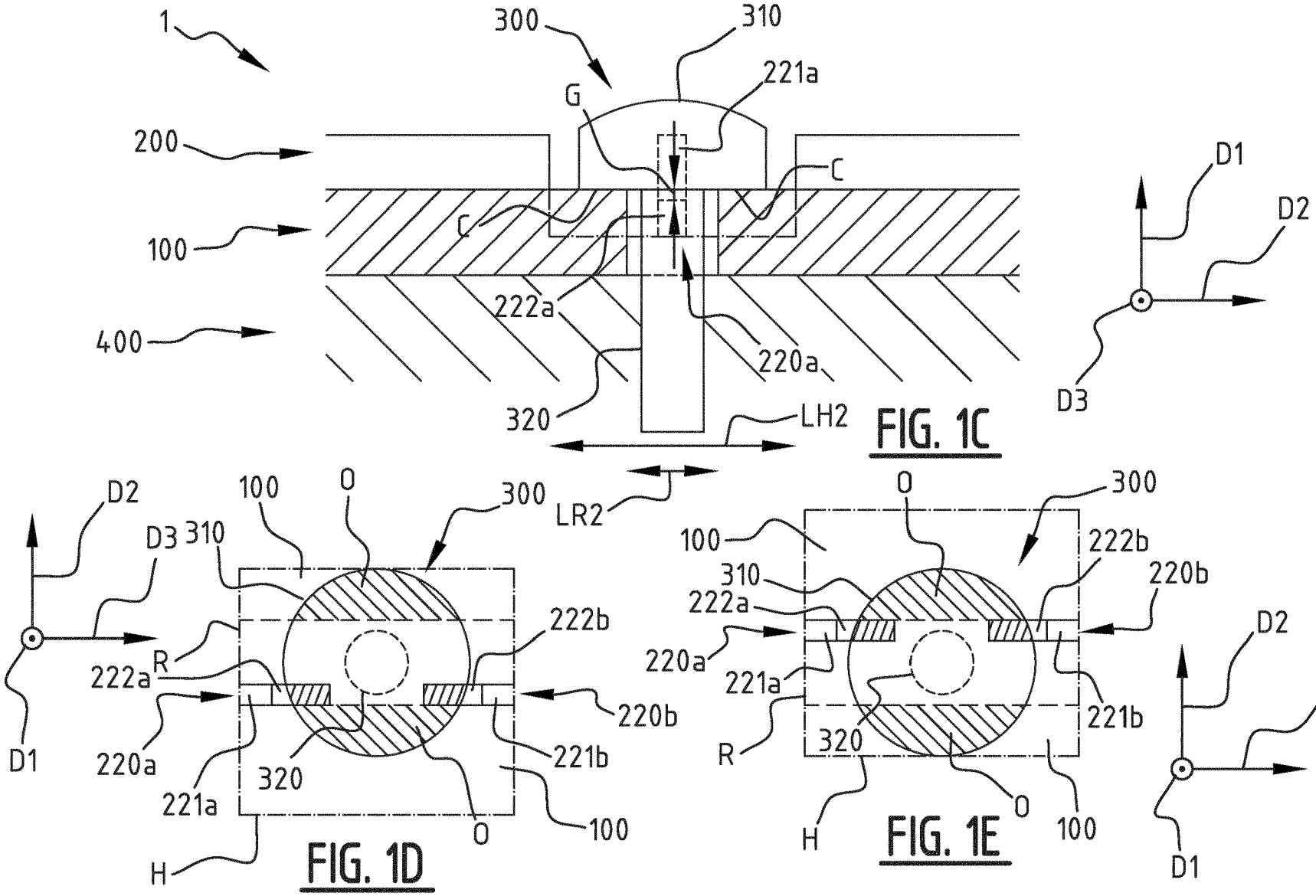

As illustrated in FIGS. 1A-1E, the second support 200 is provided with a through-hole H for receiving the head portion 310. The rod portion 320 extends through the through-hole H and the recess R in order to be fixed in a portion of the luminaire system 1. Hence, in the exemplary embodiment of FIGS. 1A-1E the rod portion 320 extends through the second support 200 and through the first support 100. In another embodiment, the rod portion 320 may be fixed in the first support 100. The second support 200 is provided with a protruding portion 220*a*, 220*b* protruding from an edge delimiting the through-hole H underneath the head portion 310 and in the recess R. As illustrated in FIGS. 1B, 1D, and 1E, an overlap O between the head portion 310 and the first support 100 is present when looking in a first direction D1 perpendicular to the first support 100. As illustrated in FIG. 1C, the head portion 310 is in contact with and supported on the first support 100 over a contact area C. The contact area C may be comprised between 25% and 75% of a surface area of the head portion 310, preferably between 33% and 66% of said surface area.

As illustrated in FIGS. 1A and 1C, when the second support 200 is supported by the first support 100 a gap G is present between the head portion 310 and the protruding portion 220*a*, 220*b* in said first direction D1. The gap G may be comprised between 0.01 mm and 0.5 mm, preferably between 0.05 mm and 0.2 mm. The gap G prevents from the risk of damaging the protruding portion 220*a*, 220*b* of the second support 200, which may be a fragile element, during the fastening operation. When the first support 100 is supported by the second support 200, the head portion 310 and the protruding portion 220*a*, 220*b* may be in contact. The second support 200 may be supported by the first support 100 during e.g. the mounting operation of the second support 200 on the first support 100, or during the fastening operation, or during any maintenance operation of the luminaire system 1. The first support 100 may be supported by the second support 200 e.g. when the luminaire system 1 is operational in an installed position, during any maintenance operation of the luminaire system or during any other operation than the above-cited operations. The dimensioning of the gap G may be such that the light distribution of the luminaire system 1 will not be affected to any notable extent by the change of distance between the head portion 310 and the protruding portion 220*a*, 220*b*, from a configuration wherein the second support 200 is supported by the first support 100 to a configuration wherein the first support 100 is supported by the second support 200. The contact between the head portion 310 and the protruding portion 220*a*, 220*b* may be such that only a limited pressure is exerted on the protruding portion 220*a*, 220*b* during the fastening operation.

Figure 6A:
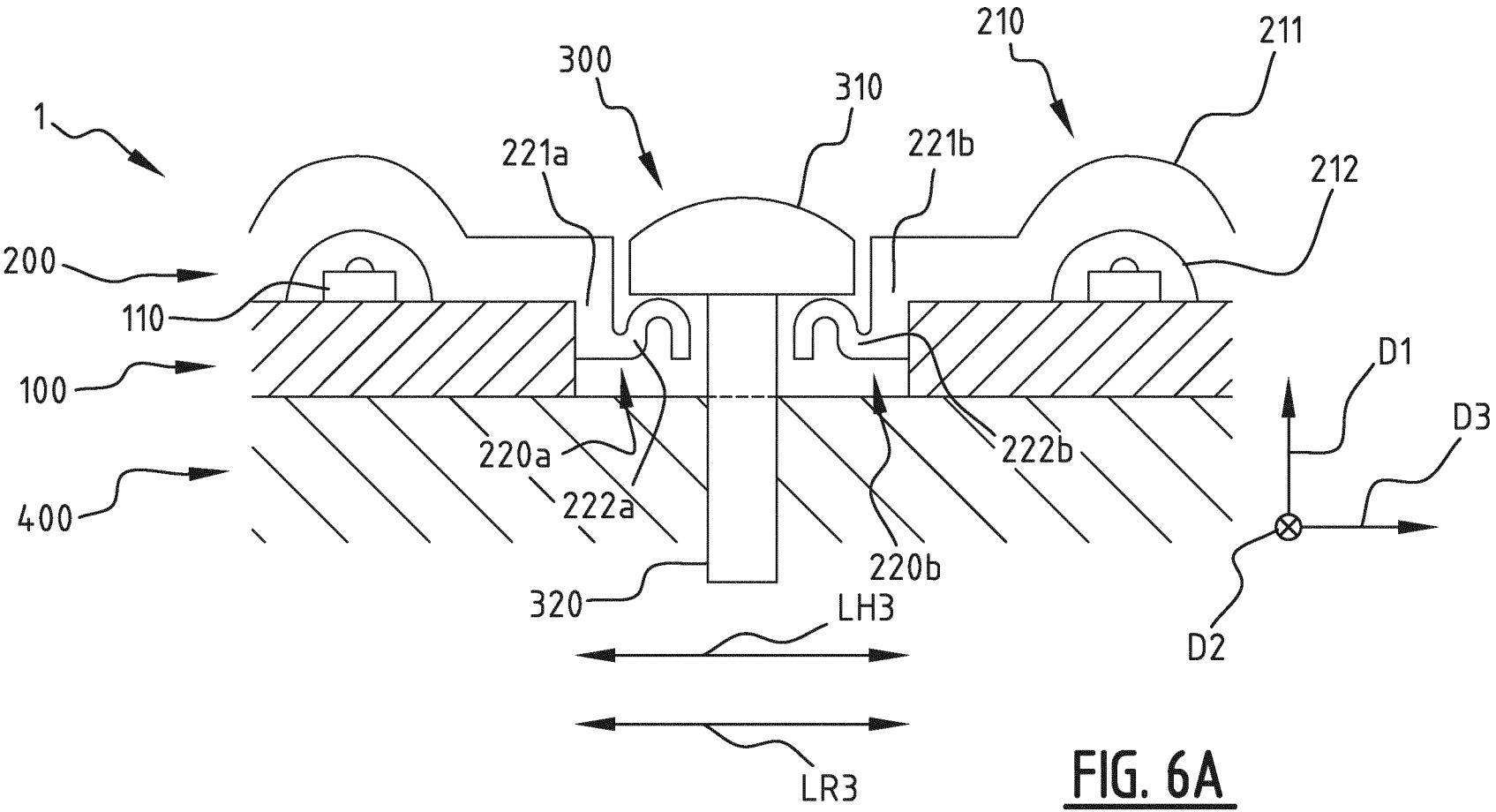
FIGS. 6A and 6B respectively illustrate a cross-sectional side view of two other exemplary embodiments of a luminaire system.
Figure 6B:
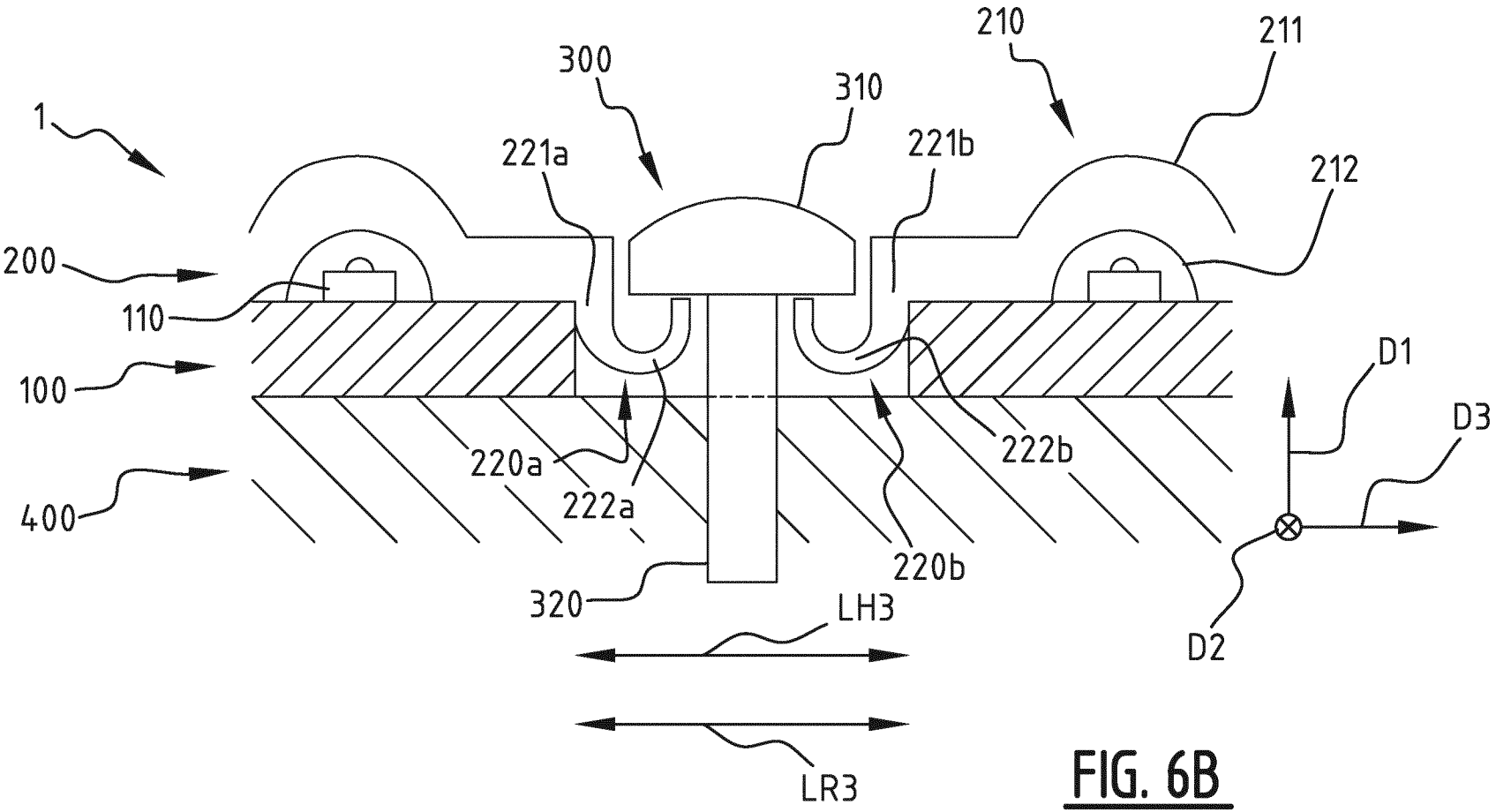

In other embodiments, such as in the embodiments of FIGS. 6A and 6B, the head portion 310 and the protruding portion 220*a*, 220*b* may be in contact when the second support 200 is supported by the first support 100, and when the first support 100 is supported by the second support 200. In these embodiments, no change of distance between the head portion 310 and the protruding portion 220*a*, 220*b* occurs from a configuration wherein the second support 200 is supported by the first support 100 to a configuration wherein the first support 100 is supported by the second support 200. The contact between the head portion 310 and the protruding portion 220*a*, 220*b* may be such that only a limited pressure is exerted on the protruding portion 220*a*, 220*b* during the fastening operation. As illustrated in FIGS. 6A and 6B, the protruding portion 220*a*, 220*b* may comprise a flexible element. Such flexible element may be curved, and may act as a spring element during the fastening operation.

Hence, the embodiment of FIGS. 1A and 1C and the embodiments of FIGS. 6A and 6B correspond to alternative embodiments preventing from the risk of damaging the protruding portion 220*a*, 220*b* of the second support 200, which may be a fragile element, during the fastening operation. In the embodiment of FIGS. 1A and 1C, the gap G is present when the second support 200 is supported by the first support 100, whereas in the embodiments of FIGS. 6A and 6B no such gap G is present, as the head portion 310 and the protruding portion 220*a*, 220*b* are in contact when the second support 200 is supported by the first support 100 and the protruding portion 220*a*, 220*b* comprises the flexible element.

In the exemplary embodiment of FIGS. 1A and 1C, the first support 100 may comprise a supporting substrate, e.g. a printed circuit board (PCB). The luminaire system 1 may further comprise a carrier 400 configured to carry the first support 100. The rod portion 320 may extend in the carrier 400. The carrier 400 may be a heat sink onto which the supporting substrate may be mounted. A housing (not shown) may be arranged around the first support 100 and may comprise a planar surface onto which the first support 100 is provided. The LEDs may be disposed on the PCB and mounted on top of a planar surface of the heat sink made of a thermally conductive material, e.g. aluminium. The surface onto which the plurality of light sources 110 is mounted on may be made reflective or white to improve the light emission.

Figure 5A:
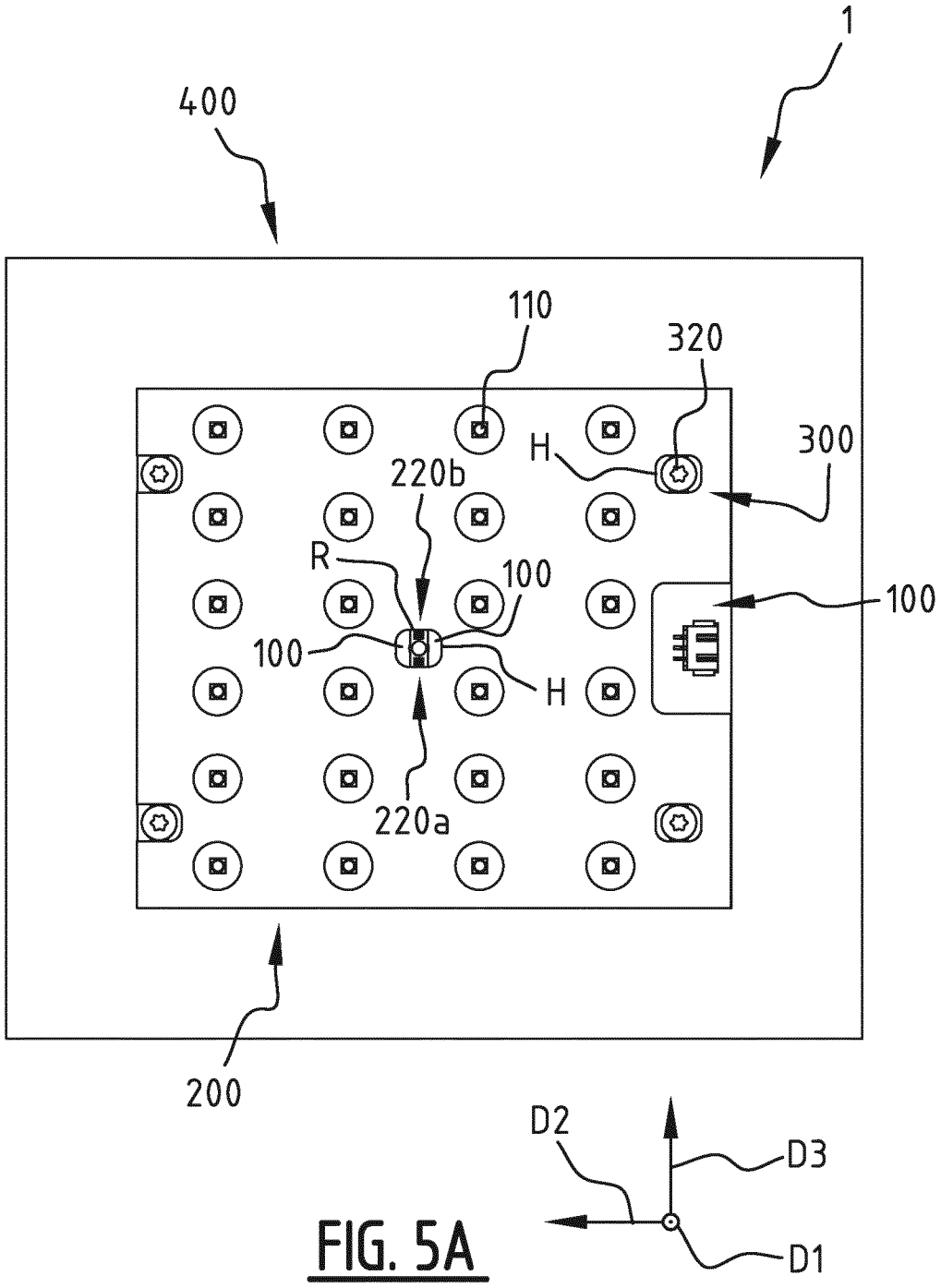
FIGS. 5A-5C respectively illustrate a top view and two enlarged top views of an exemplary embodiment of a luminaire system.

FIG. 5A illustrates a top view of an exemplary embodiment of a luminaire system. In the embodiment of FIG. 5A, the plurality of light sources 110 corresponds to 24 light sources 110 arranged in a two-dimensional array of six rows and four columns. In other embodiments, the plurality of light sources 110 may be arranged without a determined pattern, or in an array with at least two rows of light sources 110 and at least two columns of light sources 110. It should be clear for the skilled person that the number of rows and columns may vary from one embodiment to another. The luminaire system 1 as illustrated in FIG. 5A comprises a first support 100, a second support 200 arranged opposite said first support 100, and five fastening elements 300 (for clarity reasons, only four fastening elements 300 are visible in FIG. 5A), each fastening element 300 comprising a head portion 310 and a rod portion (not visible, underneath the head portion 310). Accordingly, the first support 100 is provided with five recesses R, and the second support 200 is provided with five through-holes H. The rod portion of each fastening element 300 extends through a corresponding through-hole H and a corresponding recess R in order to be fixed in a portion of the luminaire system 1. Hence, in the exemplary embodiment of FIG. 5A each rod portion extends through the second support 200 and through the first support 100. The second support 200 is provided with five protruding portions 220*a*, 220*b* each protruding portion 220*a*, 220*b* protruding from an edge delimiting a corresponding through-hole H underneath the corresponding head portion 310 and in a corresponding recess R. In other embodiments, more or less than five recesses R and through-holes H may be provided, but preferably at least two recesses R and two through-holes H.

In the embodiment of FIG. 5A, the one or more optical elements (not shown for the sake of clarity) correspond to 24 optical elements arranged in a two-dimensional array of six rows and four columns associated with the plurality of light sources 110. In other embodiments, the one or more optical elements may be arranged without a determined pattern or in an array with at least two rows of optical elements and at least two columns of optical elements. It should be clear for the skilled person that the number of rows and columns may vary from one embodiment to another. In other embodiments, some of the plurality of light sources 110 may not be associated with an optical element. In the embodiment of FIG. 5A, each optical element of the 24 optical elements extends over one corresponding light source of the 24 light sources 110, and the optical elements are similar in size and shape. In another embodiment, at least one optical element may not extend over a corresponding light source of the plurality of light sources 110. In another embodiment, some or all of the optical elements may be different from each other. In a further embodiment, there are more optical elements than light sources 110. In yet other embodiments there may be provided a plurality of LEDs below each or some of the optical element.

The one or more optical elements may be part of an integrally formed optical plate comprised in the second support 200, as illustrated in FIGS. 1A and 5A. In other words, the one or more optical elements may be interconnected so as to form an optical plate comprising the one or more optical elements. The optical plate may be formed, e.g. by injection moulding, casting, transfer moulding or in another appropriate manner. Alternatively, the one or more optical elements may be separately formed, e.g. by any one of the above mentioned techniques. The second support 200 may comprise an optical plate integrating the one or more optical elements. The optical plate may be carried by a frame (not shown). The frame may be a rectangular plate with a first surface facing the plurality of light sources 110 and a second surface opposite the first surface.

The one or more optical elements 210 may comprise a plurality of lens elements associated with the plurality of light sources 110, as illustrated in FIG. 1A. At least one lens element of the plurality of lens elements may have a first surface 211 and a second surface 212 located on opposite sides thereof. The first surface 211 is a convex surface and the second surface 212 may be a concave surface, but it may also be a planar surface, facing a light source of the plurality of light sources 110. Further, it should be clear for the skilled person that the one or more optical elements 210 may additionally or alternatively comprise other elements than lens elements, such as, reflectors, backlight elements, collimators, diffusors, and the like. At least one lens element of the plurality of lens elements may be free form in the sense that it is not rotation symmetric. In the embodiment of FIG. 1A, the lens elements have a symmetry axis. In another embodiment, the lens element may have no symmetry plane/axis at all. The lens elements are in a transparent or translucent material. They may be in optical grade silicone, glass, poly(methyl methacrylate) (PMMA), polycarbonate (PC), or polyethylene terephthalate (PET).

As illustrated in FIGS. 1B-1F, dimensions of the recess R and protruding portion 220*a*, 220*b* may be configured such that the second support 200 is movable with respect to the first support 100 along a second direction D2 parallel to the first support 100. The second support 200 may be arranged to be movable in contact with the first support 100. In another embodiment, the second support 200 may be arranged to move at a fixed/predetermined distance from the first support 100. As illustrated in FIGS. 1B-1E, a length LR2 of the recess R along said second direction D2 is greater than a length L2 of the protruding portion 220*a*, 220*b* along said second direction D2. A length LH2 of the through-hole H along said second direction D2 is greater than a length L'2 of the head portion 310 along said second direction D2. A difference between said length LH2 of the through-hole H and said length L'2 of the head portion 310 may be at least equal to a difference between said length LR2 of the recess R and said length L2 of the protruding portion 220*a*, 220*b*. In the exemplary embodiment of FIGS. 1B-1E, said difference between the length LH2 of the through-hole H and the length L'2 of the head portion 310 is equal to said difference between the length LR2 of the recess R and the length L2 of the protruding portion 220*a*, 220*b*.

FIGS. 1D and 1E illustrate two other top views of a first exemplary embodiment of a luminaire system. The second support 200 has been moved with respect to the first support 100 along a second direction D2, from a first position as illustrated in FIG. 1D to a second position as illustrated in FIG. 1E. In FIG. 1D, the protruding portion 220*a*, 220*b* is located at a first end of the recess R, whereas in FIG. 1E the protruding portion 220*a*, 220*b* is located at a second end of the recess R opposite said first end. The dimensions of the recess R and the protruding portion 220*a*, 220*b* along the second direction D2 are configured such that in FIG. 1D the head portion 310 is in contact with a first end of the through-hole H, whereas in FIG. 1E the head portion 310 is in contact with a second end of the through-hole H opposite said first end. Hence, said first and second ends of the recess R and/or of the through-hole H may act as mechanical stops in the movement of the second support 200, since the head portion 310 will abut against them at two extremal positions of the second support 200 along the second direction D2.

Figure 5B:
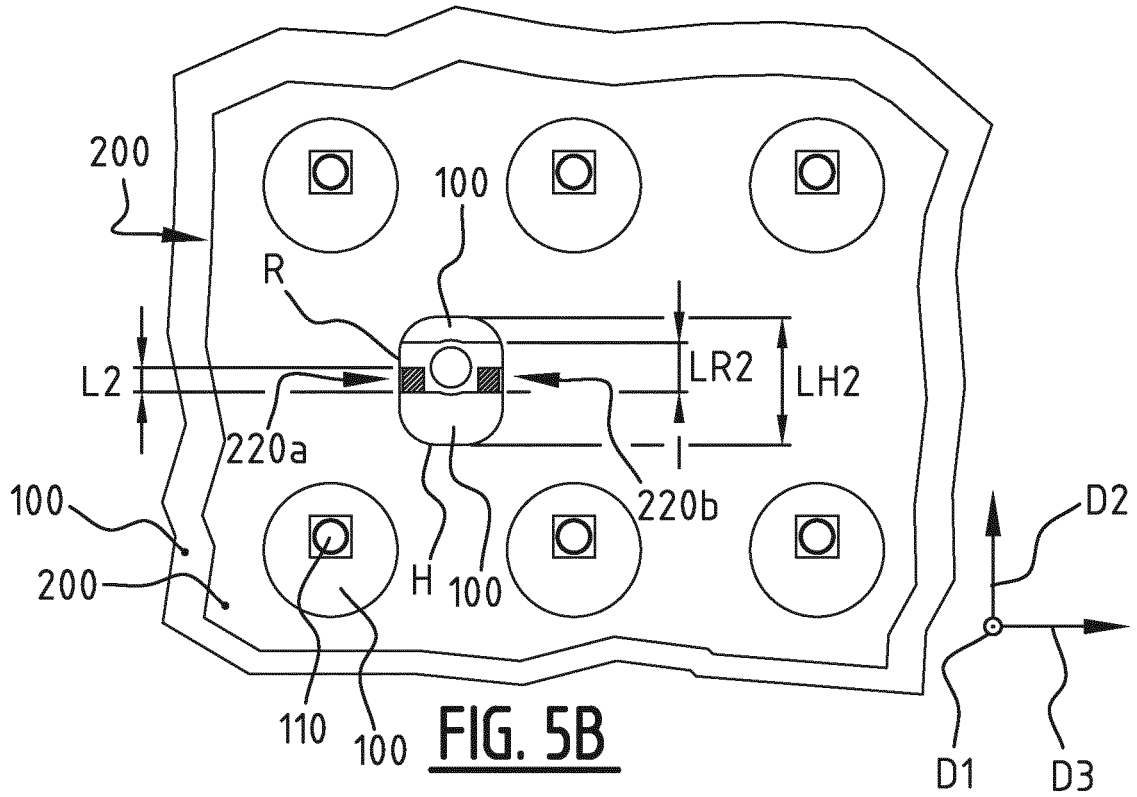
Figure 5C:
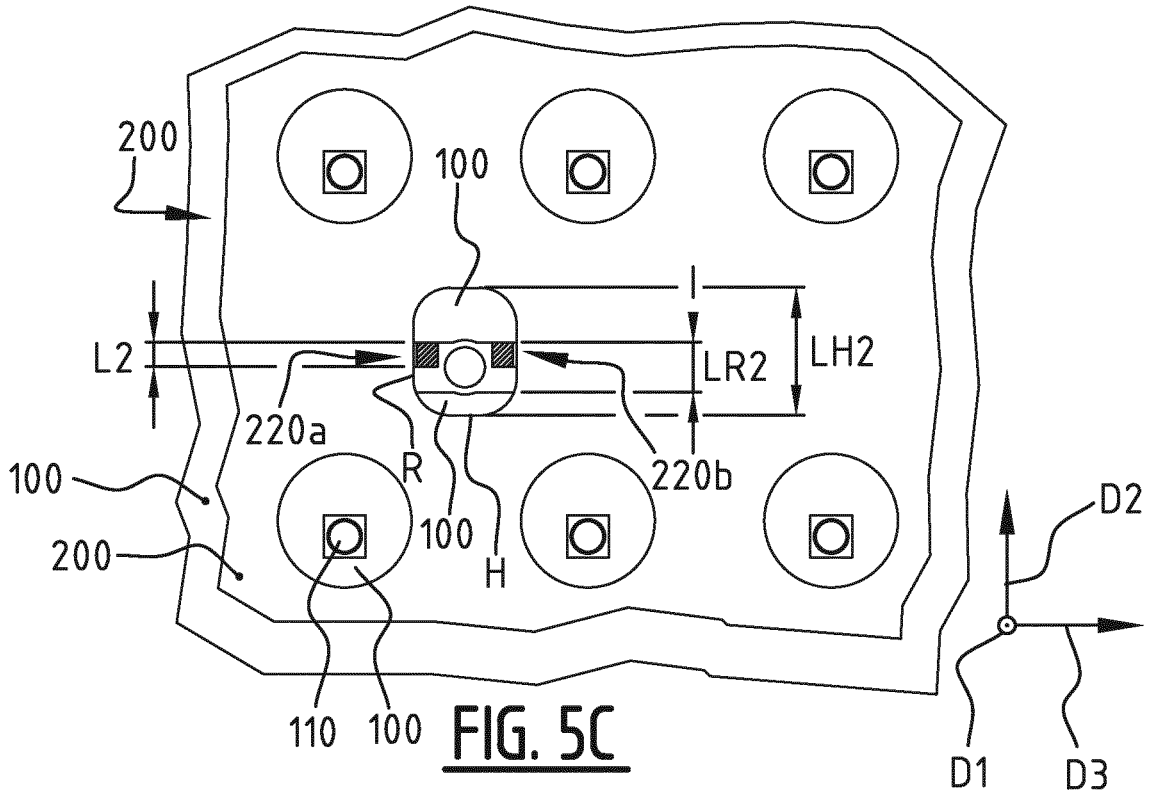

FIGS. 5B and 5C illustrate two enlarged top views of an exemplary embodiment of a luminaire system. As in FIGS. 1D and 1E, the second support 200 has been moved with respect to the first support 100 along a second direction D2, from a first position as illustrated in FIG. 5B to a second position as illustrated in FIG. 5C. In FIG. 5B, each of the five protruding portions 220*a*, 220*b* is located at a first end of a corresponding recess R, whereas in FIG. 5C each of the five protruding portions 220*a*, 220*b* is located at a second end of said corresponding recess R opposite said first end. The dimensions of each recess R and each protruding portion 220*a*, 220*b* along the second direction D2 are configured such that in FIG. 5B each head portion 310 is in contact with a first end of a corresponding through-hole H, whereas in FIG. 5C each head portion 310 is in contact with a second end of said corresponding through-hole H opposite said first end.

The luminaire system 1 may be provided with a moving means (not shown) configured to move the second support 200 relative to the first support 100, such that a position of the second support 200 with respect to the first support 100 is changed. In an exemplary embodiment, the moving means may comprise an actuation element configured to be rotatable around an axis, and a conversion element configured to convert the rotational movement of the actuation element into a movement of the second support 200 along a trajectory substantially parallel to the first support 100. Preferably, the trajectory corresponds to a straight line along the second direction D2 as illustrated in FIGS. 1B-1F and in FIGS. 5A-5C. Alternatively, said trajectory may correspond to a curved line substantially parallel to the first support 100. The actuation element may comprise a rod extending through the second support 200, said rod having a first end with a rotatable head, and a second end, and the conversion element may comprise an eccentric connected to said second end of the rod and in contact with a peripheral edge of the first support 100. Alternatively, the actuation element may comprise a wheel, and the conversion element may comprise a threaded rod having a first end connected to said wheel, and a second end mating with a threaded bore fixed in the luminaire system 1.

In another exemplary embodiment, the moving means may comprise an actuation element configured to be moved along a first trajectory, and a conversion element configured to convert the movement of the actuation element into a movement of the second support 200 along a second trajectory at an angle to said first trajectory. Preferably, the first trajectory corresponds to a straight line along an axis substantially parallel to the first support 100. Preferably, the second trajectory corresponds to a straight line along the second direction D2 as illustrated in FIGS. 1B-1F and in FIGS. 5A-5C. Alternatively, the first trajectory may correspond to a curved line substantially parallel to the first support 100, and/or the second trajectory may correspond to a curved line substantially parallel to the first support 100. The conversion element may have a contact surface at an angle with respect to the first trajectory, said contact surface being in contact with the actuation element. The actuation element may comprise an edge portion configured to be moved along said contact surface. Alternatively, the actuation element may comprise a matching surface configured to be moved in contact with said contact surface along said first trajectory.

In yet another exemplary embodiment, the moving means may comprise a rotatable element provided to one of the first support 100 or second support 200 and configured for rotating around a rotation axis perpendicular to a movement plane of the second support 200 substantially parallel to the first support 100. The rotatable element may comprise a first conversion portion cooperating with a second conversion portion, said second conversion portion provided to the other one of the first support 100 or the second support 200. The first and second conversion portions may be configured for converting a rotational movement of the rotatable element into a movement of the second support 200 with respect to the first support 100 in said movement plane. The luminaire system 1 may further comprise one or more positioning elements, and the moving means may be configured for cooperating with the one or more positioning elements to position the second support 200 with respect to the first support 100 in a plurality of predetermined positions. The one or more positioning elements may comprise one or more depressions or protuberances cooperating with at least one corresponding depression or protuberance provided to the moving means.

In yet another exemplary embodiment, the moving means may comprise a lever mounted in a rotatable manner around a rotation axis, said lever comprising a movable end portion configured for being rotated by a user or an actuator around said rotation axis, said movable end portion being located at a distance from the rotation axis. The moving means may be further configured to convert a rotation of the lever around said rotation axis into a movement of the second support 200 relative to the first support 100. The rotation axis may be substantially perpendicular to the first support 100. A leverage distance between the movable end portion of the lever and the rotation axis may be at least two times a maximum travel distance of said movement of the second support 200. The movable end portion may be an elongate element extending in a direction substantially perpendicular to the rotation axis. The luminaire system 1 may further comprise one or more positioning elements, and the moving means may be configured for cooperating with the one or more positioning elements to position the second support 200 with respect to the first support 100 in a plurality of predetermined positions.

In yet another exemplary embodiment, the moving means may comprise a bimetal.

Figure 1F:
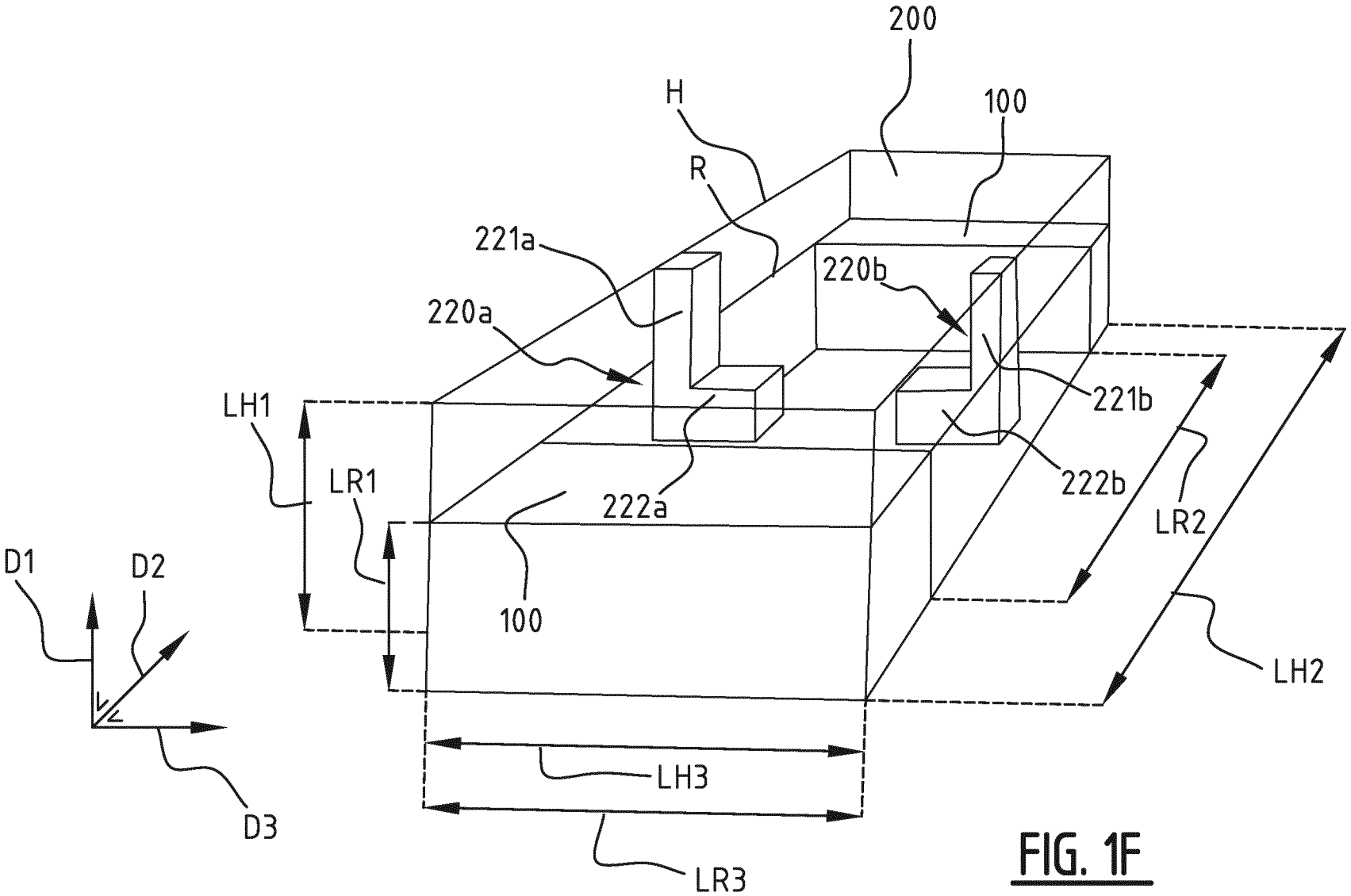

A length LR3 of the recess R along a third direction D3 parallel to the first support 100 and perpendicular to the second direction D2 may be at most equal to a length LH3 of the through-hole H along said third direction D3. As illustrated in FIGS. 1A, 1B, and 1F, said length LR3 is equal to said length LH3. The protruding portion 220*a*, 220*b* comprises a first protruding portion 221*a*, 221*b* extending in the first direction D1 into the recess R, and a second protruding portion 222*a*, 222*b* connected to an end of said first protruding portion 221*a*, 221*b* and extending in the third direction D3 underneath the head portion 310.

FIGS. 2A-2E respectively illustrate a cross-sectional side view, a top view, another cross-sectional side view, and two other top views of a second exemplary embodiment of a luminaire system.

Figure 2A:
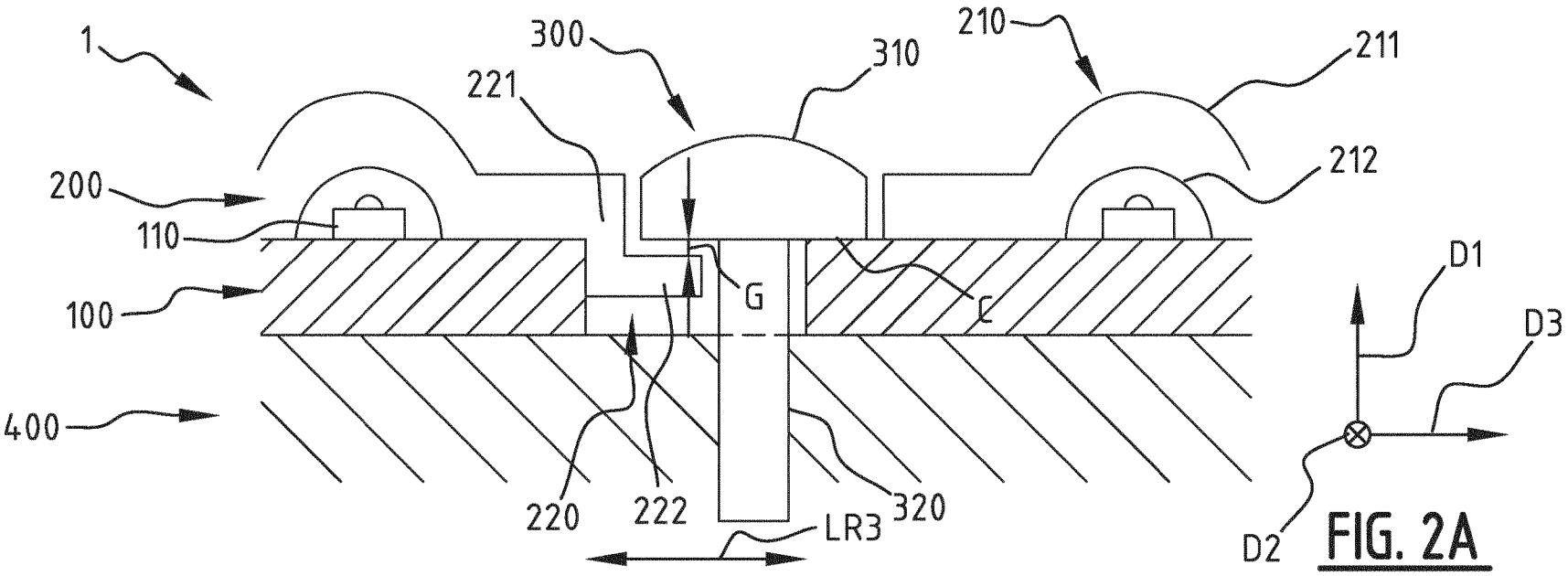
FIGS. 2A-2E respectively illustrate a cross-sectional side view, a top view, another cross-sectional side view, and two other top views of a second exemplary embodiment of a luminaire system.
Figure 2B:
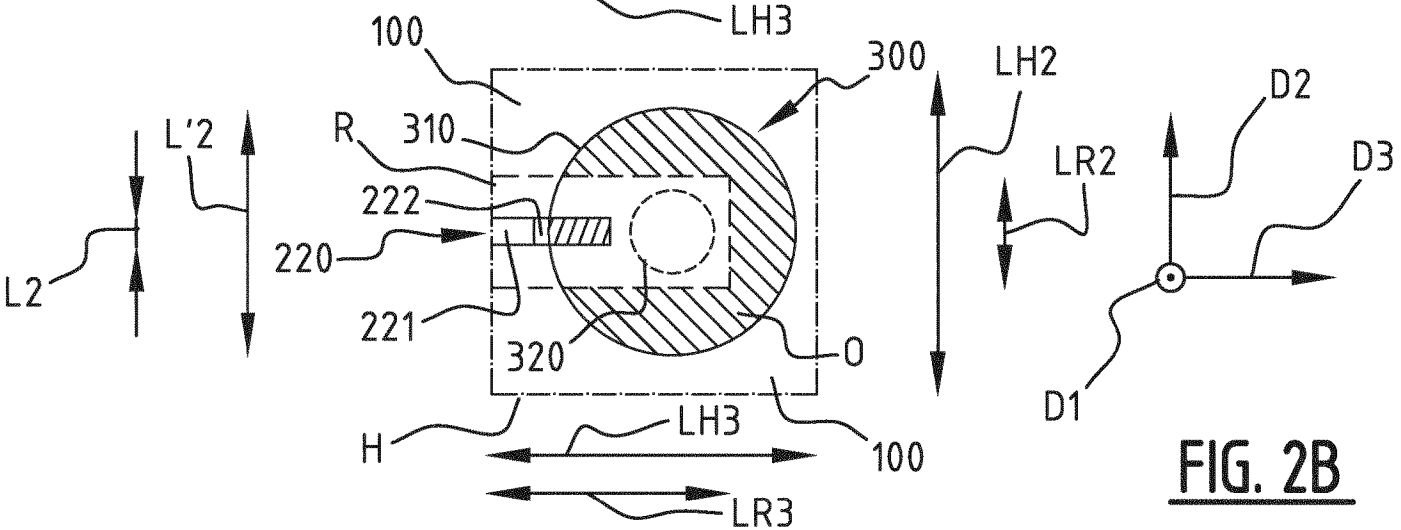
Figures 2C, 2D, 2E:
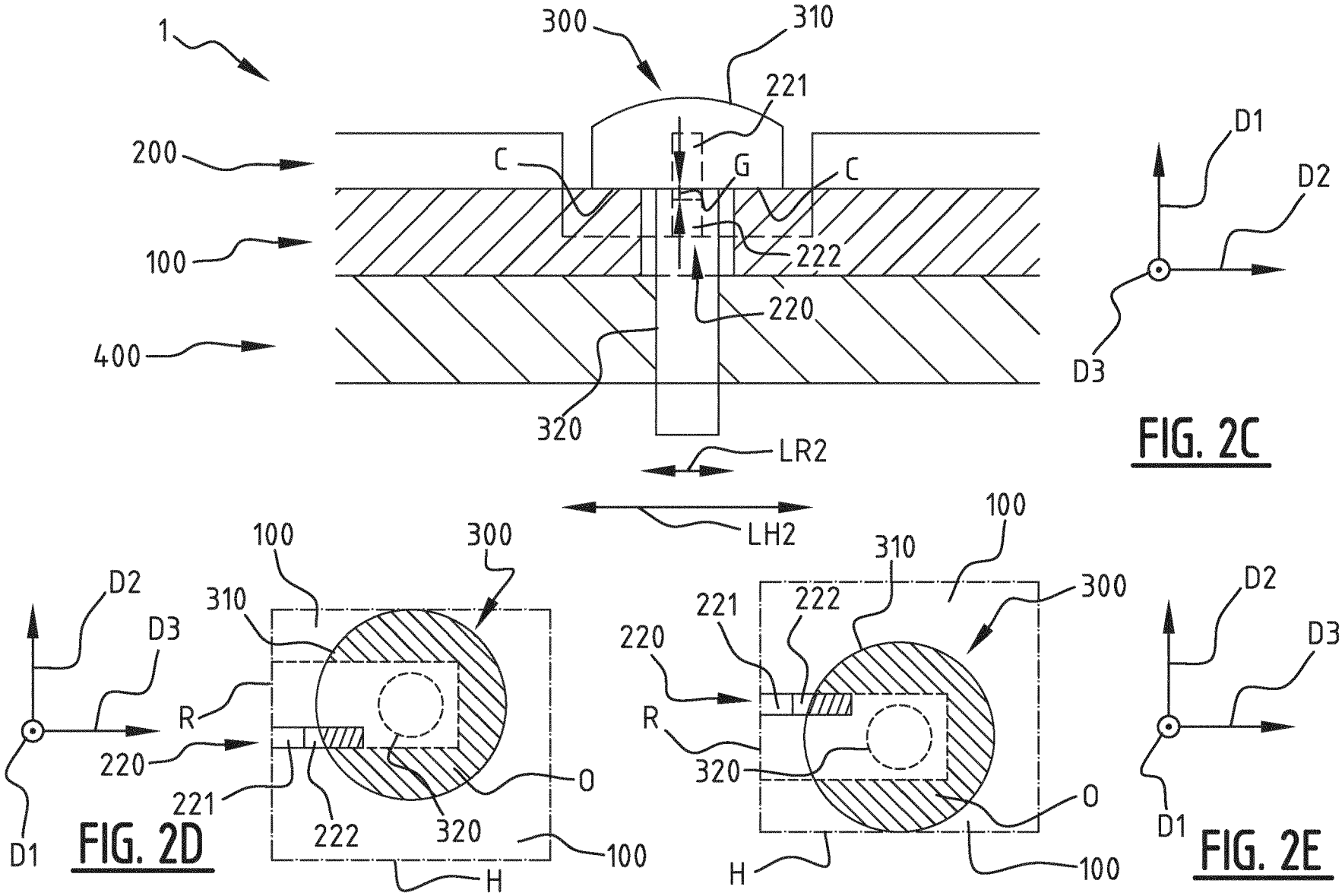

As illustrated in FIGS. 2A-2E, the luminaire system 1 comprises a first support 100, a second support 200 arranged opposite said first support 100, and a fastening element 300 comprising a head portion 310 and a rod portion 320. As illustrated in FIG. 2A, a plurality of light sources 110 is arranged on the first support 100. One or more optical elements 210 are provided to the second support 200, and are associated with the plurality of light sources 110. The second support 200 is provided with a through-hole H for receiving the head portion 310. The rod portion 320 extends through the through-hole H and the recess R in order to be fixed in a portion of the luminaire system 1. Hence, in the exemplary embodiment of FIGS. 2A-2E the rod portion 320 extends through the second support 200 and through the first support 100. In another embodiment, the rod portion 320 may be fixed in the first support 100. The second support 200 is provided with a protruding portion 220 protruding from an edge delimiting the through-hole H underneath the head portion 310 and in the recess R. In contrast to the exemplary embodiment of FIGS. 1A-1E, in the embodiment of FIGS. 2A-2E the second support 200 is provided with a protruding portion 220 only on one edge of the through-hole H. As illustrated in FIGS. 2B, 2D, and 2E, an overlap O between the head portion 310 and the first support 100 is present when looking in a first direction D1 perpendicular to the first support 100. As illustrated in FIGS. 2A and 2C, the head portion 310 is in contact with the first support 100 over a contact area C. The contact area C may be comprised between 25% and 75% of a surface area of the head portion 310, preferably between 33% and 66% of said surface area. In the embodiment of FIGS. 2B, 2D, and 2E, the overlap O is greater than the overlap illustrated in FIGS. 1B, 1D, and 1E, since the contact area C illustrated in FIGS. 2A and 2C is greater than the contact area illustrated in FIG. 1C.

As illustrated in FIGS. 2A and 2C, when the second support 200 is supported by the first support 100 a gap G is present between the head portion 310 and the protruding portion 220 in said first direction D1. The gap G may be comprised between 0.01 mm and 0.5 mm, preferably between 0.05 mm and 0.2 mm. When the first support 100 is supported by the second support 200, the head portion 310 and the protruding portion 220 may be in contact. The dimensioning of the gap G may be such that the light distribution of the luminaire system 1 will not be affected to any notable extent by the change of distance between the head portion 310 and the protruding portion 220, from a configuration wherein the second support 200 is supported by the first support 100 to a configuration wherein the first support 100 is supported by the second support 200. The contact between the head portion 310 and the protruding portion 220 may be such that only a limited pressure is exerted on the protruding portion 220 during the fastening operation.

In the exemplary embodiment of FIGS. 2A and 2C, the first support 100 may comprise a supporting substrate, e.g. a PCB. The luminaire system 1 may further comprise a carrier 400 configured to carry the first support 100. The rod portion 320 may extend in the carrier 400. The carrier 400 may be a heat sink onto which the supporting substrate may be mounted.

As illustrated in FIGS. 2B-2F, dimensions of the recess R and protruding portion 220 may be configured such that the second support 200 is movable with respect to the first support 100 along a second direction D2 parallel to the first support 100. The second support 200 may be arranged to be movable in contact with the first support 100. In another embodiment, the second support 200 may be arranged to move at a fixed/predetermined distance from the first support 100. As illustrated in FIGS. 2B-2E, a length LR2 of the recess R along said second direction D2 is greater than a length L2 of the protruding portion 220 along said second direction D2. A length LH2 of the through-hole H along said second direction D2 is greater than a length L'2 of the head portion 310 along said second direction D2. As in the embodiment of FIGS. 1B-1E, in the embodiment of FIGS. 2B-2E a difference between said length LH2 of the through-hole H and said length L'2 of the head portion 310 is equal to a difference between said length LR2 of the recess R and said length L2 of the protruding portion 220.

FIGS. 2D and 2E illustrate two other top views of a second exemplary embodiment of a luminaire system. The second support 200 has been moved with respect to the first support 100 along a second direction D2, from a first position as illustrated in FIG. 2D to a second position as illustrated in FIG. 2E. In FIG. 2D, the protruding portion 220 is located at a first end of the recess R, whereas in FIG. 2E the protruding portion 220 is located at a second end of the recess R opposite said first end. The dimensions of the recess R and the protruding portion 220 along the second direction D2 are configured such that in FIG. 2D the head portion 310 is in contact with a first end of the through-hole H, whereas in FIG. 2E the head portion 310 is in contact with a second end of the through-hole H opposite said first end. Hence, as in FIGS. 1D and 1E said first and second ends of the recess R and/or of the through-hole H may act as mechanical stops in the movement of the second support 200.

The luminaire system 1 may be provided with a moving means (not shown) configured to move the second support 200 relative to the first support 100, such that a position of the second support 200 with respect to the first support 100 is changed. The moving means may correspond to any of the embodiments described in connection with FIGS. 1B-1F and FIGS. 5A-5C.

A length LR3 of the recess R along a third direction D3 parallel to the first support 100 and perpendicular to the second direction D2 may be at most equal to a length LH3 of the through-hole H along said third direction D3. As illustrated in FIGS. 2A and 2B, said length LR3 is smaller than said length LH3, in contrast to the embodiment of FIGS. 1A, 1B, and 1F, wherein said length LR3 is equal to said length LH3. The protruding portion 220 comprises a first protruding portion 221 extending in the first direction D1 into the recess R, and a second protruding portion 222 connected to an end of said first protruding portion 221 and extending in the third direction D3 underneath the head portion 310.

Figure 3A:
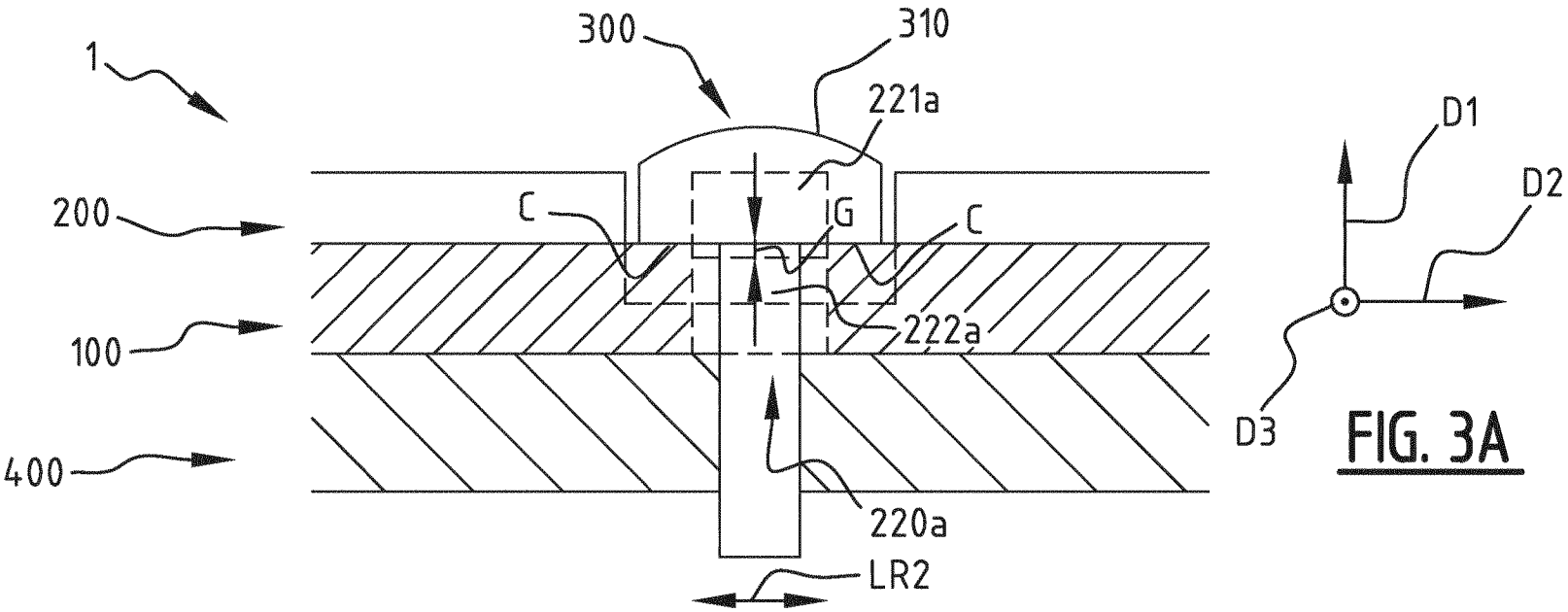
FIGS. 3A and 3B respectively illustrate a cross-sectional side view and a top view of a third exemplary embodiment of a luminaire system.
Figure 3B:
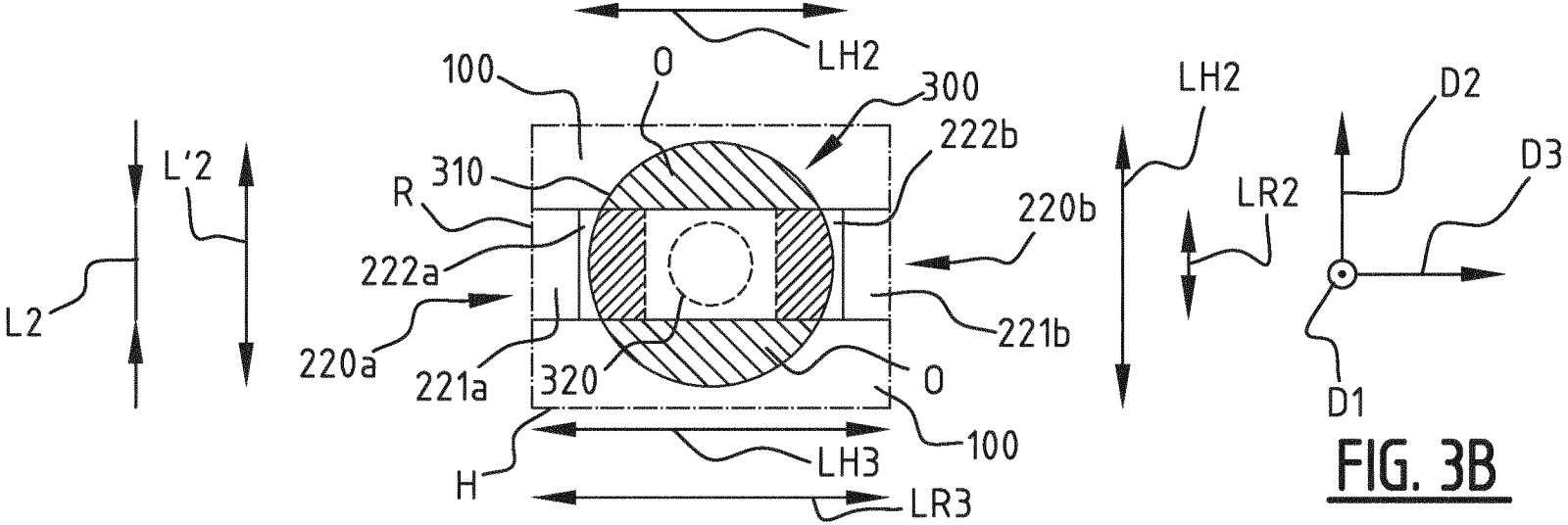

FIGS. 3A and 3B respectively illustrate a cross-sectional side view and a top view of a third exemplary embodiment of a luminaire system.

As illustrated in FIGS. 3A and 3B, the luminaire system 1 comprises a first support 100, a second support 200 arranged opposite said first support 100, and a fastening element 300 comprising a head portion 310 and a rod portion 320. The second support 200 is provided with a through-hole H for receiving the head portion 310. The rod portion 320 extends through the through-hole H and the recess R in order to be fixed in a portion of the luminaire system 1. Hence, the rod portion 320 extends through the second support 200 and through the first support 100. As in the exemplary embodiment of FIGS. 2A-2E, the second support 200 is provided with a protruding portion 220*a*, 220*b* protruding from an edge delimiting the through-hole H underneath the head portion 310 and in the recess R. An overlap O between the head portion 310 and the first support 100 is present when looking in a first direction D1 perpendicular to the first support 100. The head portion 310 is in contact with and supported on the first support 100 over a contact area C. The contact area C may be comprised between 25% and 75% of a surface area of the head portion 310, preferably between 33% and 66% of said surface area. In the embodiment of FIG. 3B, the overlap O is equal to the overlap illustrated in FIGS. 2B, 2D, and 2E, since the contact area C illustrated in FIG. 3A is equal to the contact area illustrated in FIG. 1C.

As illustrated in FIG. 3A, when the second support 200 is supported by the first support 100 a gap G is present between the head portion 310 and the protruding portion 220*a*, 220*b* in said first direction D1. The gap G may be comprised between 0.01 mm and 0.5 mm, preferably between 0.05 mm and 0.2 mm. When the first support 100 is supported by the second support 200, the head portion 310 and the protruding portion 220 may be in contact.

In the exemplary embodiment of FIG. 3A, the first support 100 may comprise a supporting substrate, e.g. a PCB. The luminaire system 1 may further comprise a carrier 400 configured to carry the first support 100. The rod portion 320 may extend in the carrier 400. The carrier 400 may be a heat sink onto which the supporting substrate may be mounted.

In contrast to the exemplary embodiment of FIGS. 1B-1F and FIGS. 2B-2E, in the embodiment of FIGS. 3A and 3B dimensions of the recess R and protruding portion 220 are configured such that the second support 200 is not movable with respect to the first support 100 along a second direction D2 parallel to the first support 100. Indeed, as illustrated in FIG. 3B a length LR2 of the recess R along said second direction D2 is equal to a length L2 of the protruding portion 220*a*, 220*b* along said second direction D2. A length LH2 of the through-hole H along said second direction D2 is equal to a length L'2 of the head portion 310 along said second direction D2.

A length LR3 of the recess R along a third direction D3 parallel to the first support 100 and perpendicular to the second direction D2 may be at most equal to a length LH3 of the through-hole H along said third direction D3. As illustrated in FIG. 3B, said length LR3 is equal to said length LH3, as in the embodiment of FIGS. 1A, 1B, and 1F. The protruding portion 220*a*, 220*b* comprises a first protruding portion 221*a*, 221*b* extending in the first direction D1 into the recess R, and a second protruding portion 222*a*, 222*b* connected to an end of said first protruding portion 221*a*, 221*b* and extending in the third direction D3 underneath the head portion 310.

Figure 4A:
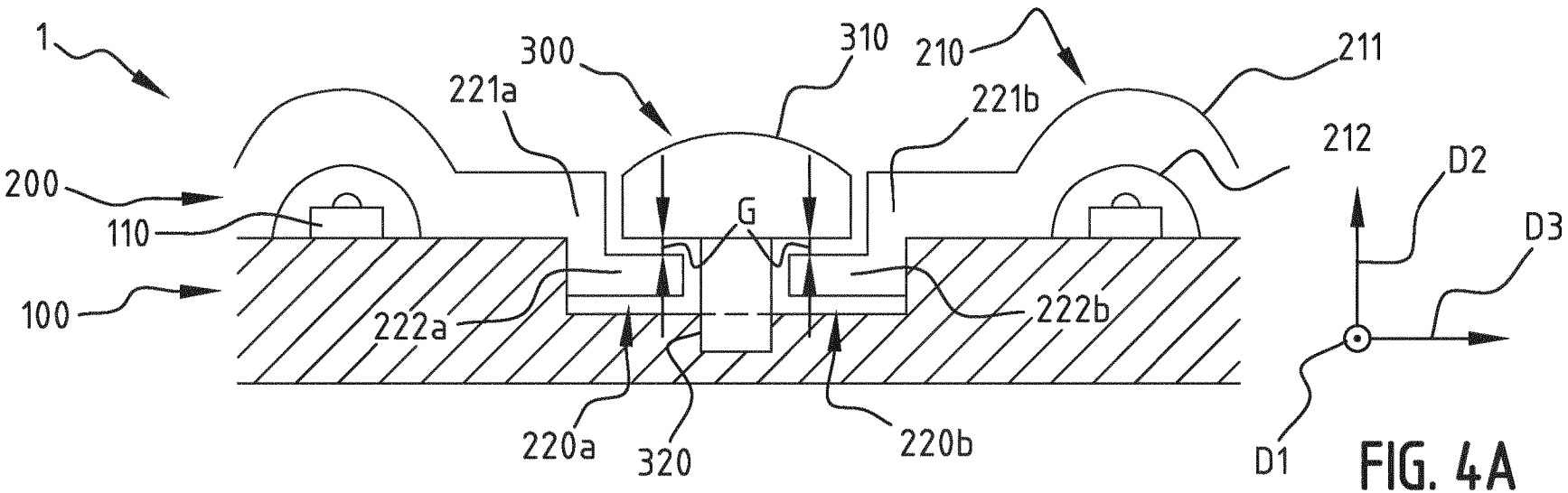
FIGS. 4A-4C respectively illustrate a cross-sectional side view, a top view, and another cross-sectional side view of a fourth exemplary embodiment of a luminaire system.
Figure 4B:
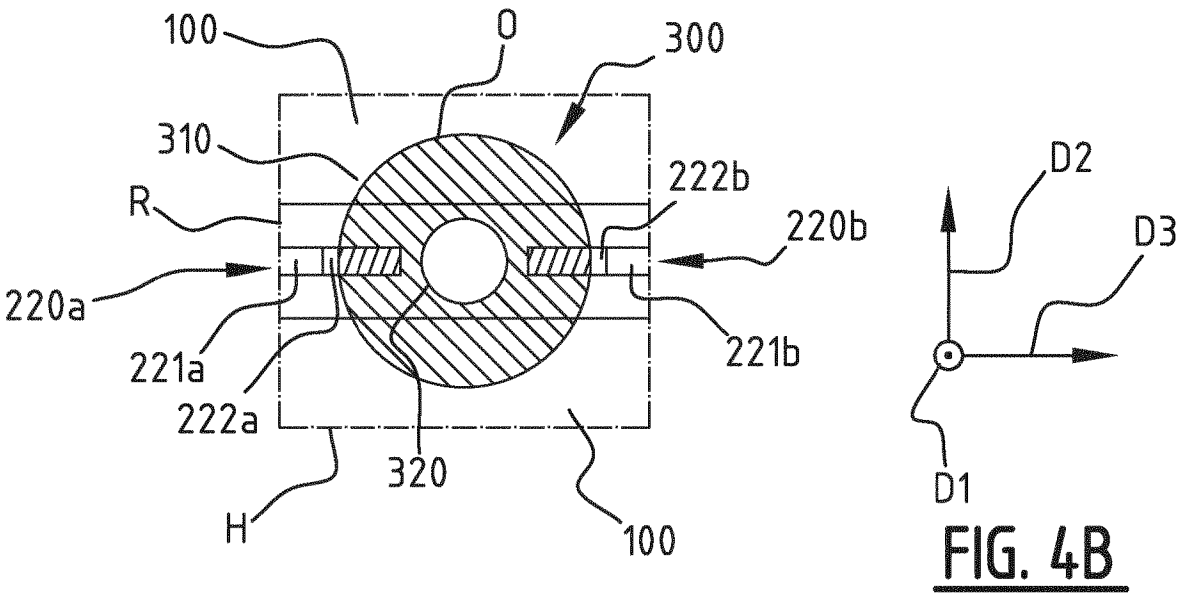
Figure 4C:
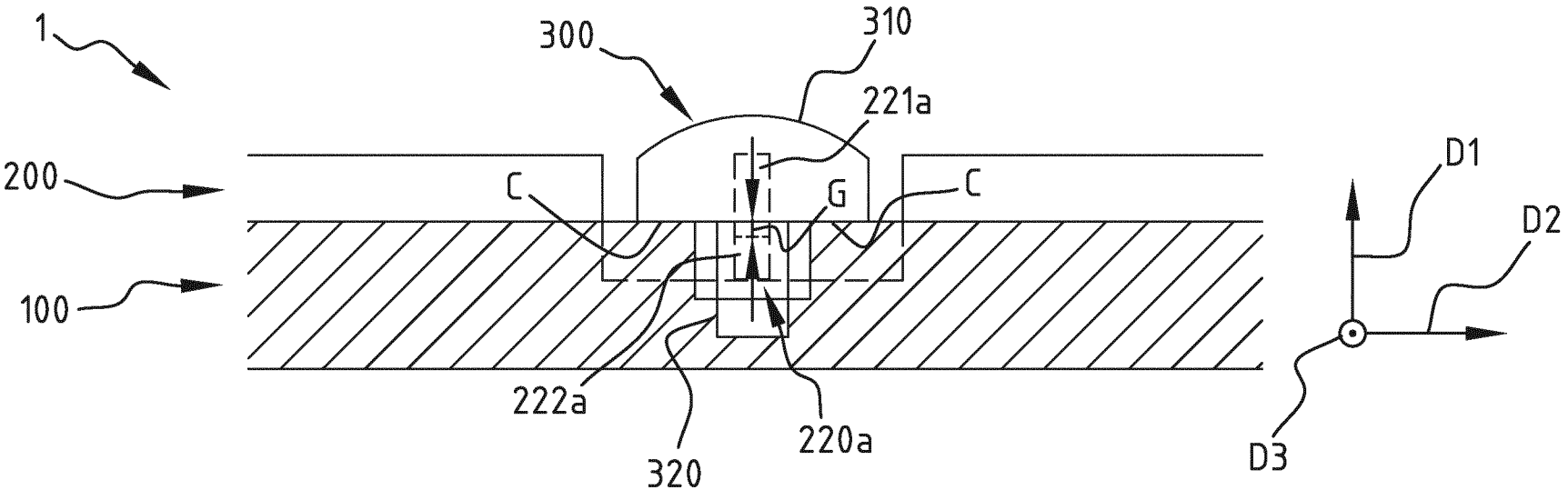

FIGS. 4A-4C respectively illustrate a cross-sectional side view, a top view, and another cross-sectional side view of a fourth exemplary embodiment of a luminaire system.

As illustrated in FIGS. 4A-4C, the luminaire system 1 comprises a first support 100, a second support 200 arranged opposite said first support 100, and a fastening element 300 comprising a head portion 310 and a rod portion 320. The second support 200 is provided with a through-hole H for receiving the head portion 310. The rod portion 320 extends through the through-hole H and in the recess R in order to be fixed in the first support 100. Hence, the rod portion 320 only extends through the second support 200, in contrast to the exemplary embodiments of FIGS. 1A-3B. The first support 100 may comprise a supporting substrate, e.g. a PCB. The luminaire system 1 may further comprise a carrier (not shown) configured to carry the first support 100, but the rod portion 320 does not extend in the carrier. The carrier may be a heat sink onto which the supporting substrate may be mounted. The second support 200 is provided with a protruding portion 220*a*, 220*b* protruding from an edge delimiting the through-hole H underneath the head portion 310 and in the recess R. An overlap O between the head portion 310 and the first support 100 is present when looking in a first direction D1 perpendicular to the first support 100. In the embodiment of FIG. 4B, the overlap O is greater than the overlap illustrated in the embodiments of FIGS. 1A-3B, since the rod portion 320 extends in the recess R in order to be fixed in the first support 100 and not in a portion of the luminaire system 1, e.g. in the carrier. Hence, said overlap O corresponds to a surface area of the head portion 310 minus a surface area of the rod portion 320.

The head portion 310 is in contact with and supported on the first support 100 over a contact area C. The contact area C may be comprised between 25% and 75% of a surface area of the head portion 310, preferably between 33% and 66% of said surface area.

As illustrated in FIGS. 4A and 4C, when the second support 200 is supported by the first support 100 a gap G is present between the head portion 310 and the protruding portion 220*a*, 220*b* in said first direction D1. The gap G may be comprised between 0.01 mm and 0.5 mm, preferably between 0.05 mm and 0.2 mm. When the first support 100 is supported by the second support 200, the head portion 310 and the protruding portion 220 may be in contact.

In the embodiment of FIGS. 4A-4C, dimensions of the recess R and protruding portion 220*a*, 220*b* are configured such that the second support 200 is movable with respect to the first support 100 along a second direction D2 parallel to the first support 100. A length LR3 of the recess R along a third direction D3 parallel to the first support 100 and perpendicular to the second direction D2 may be at most equal to a length LH3 of the through-hole H along said third direction D3. The protruding portion 220*a*, 220*b* comprises a first protruding portion 221*a*, 221*b* extending in the first direction D1 into the recess R, and a second protruding portion 222*a*, 222*b* connected to an end of said first protruding portion 221*a*, 221*b* and extending in the third direction D3 underneath the head portion 310.

The luminaire system 1 may be provided with a moving means (not shown) configured to move the second support 200 relative to the first support 100, such that a position of the second support 200 with respect to the first support 100 is changed. The moving means may correspond to any of the embodiments described in connection with FIGS. 1B-1F, FIGS. 2B-2E, and FIGS. 5A-5C.

Whilst the principles of the invention have been set out above in connection with specific embodiments, it is to be understood that this description is merely made by way of example and not as a limitation of the scope of protection which is determined by the appended claims.

The invention claimed is:

1. A luminaire system comprising:

a first support provided with a recess;

a plurality of light sources arranged on said first support;

a second support arranged opposite said first support;

one or more optical elements provided to said second support, and associated with the plurality of light sources; and a fastening element comprising a head portion and a rod portion;

wherein the second support is provided with a through-hole for receiving said head portion;

wherein said rod portion extends through said through-hole and said recess in order to be fixed in the first support and/or in a portion of the luminaire system;

wherein the second support is provided with a protruding portion protruding from an edge delimiting the through-hole underneath the head portion and in the recess;

wherein an overlap between the head portion and the first support is present when looking in a first direction perpendicular to the first support;

wherein a gap is present between the head portion and the protruding portion in said first direction when the second support is supported by the first support; and wherein the head portion and the protruding portion are in contact when the first support is supported by the second support.

2. The luminaire system according to claim 1, wherein the head portion is in contact with the first support over a contact area.

3. The luminaire system according to claim 2, wherein said contact area is comprised between 25% and 75% of a surface area of the head portion.

4. The luminaire system according to claim 1, wherein said gap is between 0.01 mm and 0.5 mm.

5. The luminaire system according to claim 1, wherein the rod portion extends through the second support and through the first support.

6. The luminaire system according to claim 1, wherein dimensions of the recess and protruding portion are configured such that the second support is movable with respect to the first support along a second direction parallel to the first support.

7. The luminaire system according to claim 6, wherein a length of the recess along said second direction is greater than a length of the protruding portion along said second direction; and wherein a length of the through-hole along said second direction is greater than a length of the head portion along said second direction.

8. The luminaire system according to claim 7, wherein a difference between said length of the through-hole and said length of the head portion is at least equal to a difference between said length of the recess and said length of the protruding portion.

9. The luminaire system according to claim 6, wherein the second support is arranged to be movable in contact with the first support.

10. The luminaire system according to claim 6, wherein a length of the recess along a third direction parallel to the first support and perpendicular to the second direction is at most equal to a length of the through-hole along said third direction.

11. The luminaire system according to claim 10, wherein the protruding portion comprises a first protruding portion extending in the first direction into the recess, and a second protruding portion connected to an end of said first protruding portion and extending in the third direction underneath the head portion.

12. The luminaire system according to claim 1, further comprising a carrier configured to carry the first support.

13. The luminaire system according to claim 12, wherein the rod portion extends in the carrier; and/or wherein the carrier is a heat sink.

14. The luminaire system according to claim 1, wherein the first support is a printed circuit board.

15. The luminaire system according to claim 1, wherein the one or more optical elements comprise a plurality of lens elements associated with the plurality of light sources.

16. The luminaire system according to claim 1, wherein the second support and the first support are arranged such that an optical element of the one or more optical elements extends over a corresponding light source of the plurality of light sources.

17. The luminaire system according to claim 1, wherein the second support comprises an optical plate integrating the one or more optical elements.

18. The luminaire system according to claim 15, wherein a lens element of the plurality of lens elements has a first surface and a second surface located on opposite sides thereof, wherein the first surface is a convex or planar surface and the second surface is a concave or planar surface facing a light source of the plurality of light sources.

19. The luminaire system according to claim 1, wherein the light sources are arranged in a two-dimensional array of at least two rows and at least two columns.

* * * * *